United States Patent [19]

Nelsen

[11] 4,381,104

[45] Apr. 26, 1983

[54] STRINGER CLAMP

[75] Inventor: Arnold Nelsen, Kirkland, Wash.

[73] Assignee: The Boeing Company, Seattle, Wash.

[21] Appl. No.: 192,349

[22] Filed: Sep. 29, 1980

[51] Int. Cl.[3] ..... B25B 1/20

[52] U.S. Cl. ..... 269/43; 269/101; 269/156; 269/249; 269/258; 269/266; 269/269; 294/103 R

[58] Field of Search ..... 269/258, 262, 265, 266, 269/268, 269, 249, 43, 156, 101, 303, 97, 315, 304; 294/103; 144/269

[56] References Cited

U.S. PATENT DOCUMENTS

| | | | |
|---|---|---|---|
| 86,173 | 1/1869 | Maynard | 269/75 |
| 386,631 | 7/1889 | Garrison et al. | 269/258 |
| 1,319,900 | 10/1919 | Reeder | 269/97 |
| 1,486,158 | 3/1924 | Price | 269/101 |
| 1,918,439 | 7/1933 | Warman | 269/258 |
| 2,164,455 | 7/1939 | Hart | 269/243 |
| 3,425,098 | 2/1962 | Bredvir | 269/249 |
| 3,738,639 | 6/1973 | Berlyn | 269/303 |
| 4,181,392 | 1/1980 | Casler et al. | 269/258 |

*Primary Examiner*—Robert C. Watson

*Attorney, Agent, or Firm*—Christensen, O'Connor, Johnson & Kindness

[57] ABSTRACT

A clamp for use in holding a wing panel stringer to a header on a wing panel jig includes a clamp base affixed to the header. A stringer locator, which has a pair of clamp-engaging surfaces, is mounted for rotational movement on the clamp base. The first clamp-engaging surface is oriented generally parallel to the rotational axis of the locator while the second surface is a locus of lines that are preferably generally perpendicular to the first surface and form a convexly arcuate second surface. A J-shaped clamping member is slidably and rotationally mounted in the clamp base. The terminus of the curved portion of the clamping member engages the exposed surface of a stringer to hold it tightly against the first and second clamp surfaces.

4 Claims, 8 Drawing Figures

Fig. 4.
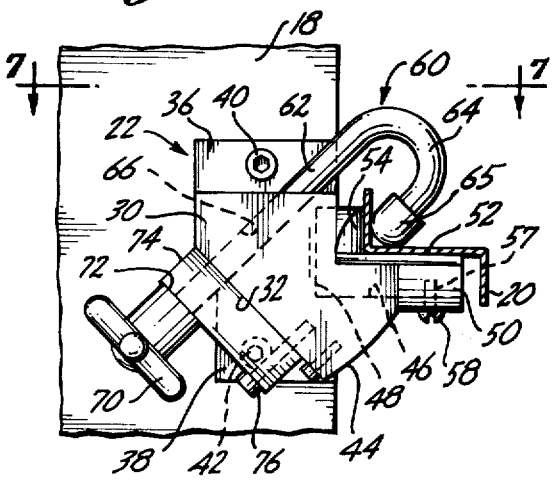
Fig. 5.
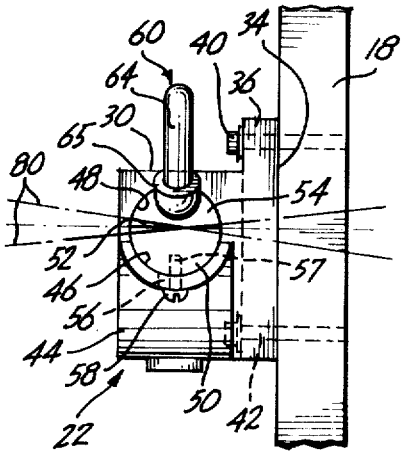
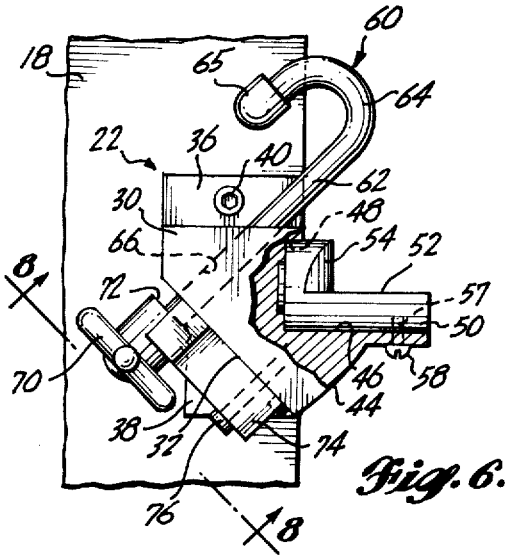
Fig. 6.
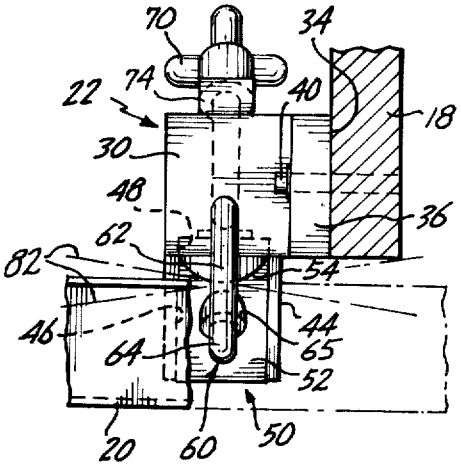
Fig. 7.
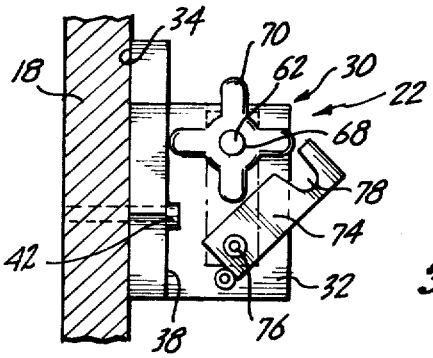
Fig. 8.

STRINGER CLAMP

BACKGROUND OF THE INVENTION

Airplane wing panels, composed of wing skins and generally spanwise extending reinforcing beams or stringers, are constructed on jigs. The stringers are positioned in clamps which, in turn, are attached to jig headers. The surface panels are then fastened to the stringers with conventional fasteners. Because the contour of the wing panels varies in both the spanwise and chordwise directions, the orientation of the stringers relative to the headers will vary slightly but continuously in successive clamping locations in both the spanwise and chordwise directions.

Heretofore, stringer clamps were specially designed and machined for each of the many stringer clamping locations so that the surfaces of an L-shaped portion of the stringers could abut a first clamping surface oriented generally parallel with the wing skin and a second clamping surface oriented generally perpendicular to the chordwise direction relative to the panel. One or both of these clamping surfaces were necessarily machined to a precise angle dictated by the particular clamping position and stringer orientation, so that the stringer surfaces could abut flat clamping surfaces. In an attempt to eliminate some of the machining on one of the surfaces, acruate, plastic inserts have been substituted for the machined surfaces that are parallel to the wing skin. Although satisfactory, the plastic inserts are subject to wear and thus require periodic replacement in order to retain precise alignment of successive sets of stringers relative to the jig.

Intermediate size commercial airplanes have about 250 clamping locations for the upper and lower wing panels for each of the left and right airplane wings, requiring about 500 different clamp configurations in all. The production and marking of that many clamps in accordance with the prior clamping techniques represents a significant investment. It was therefore an overall objective of the present invention to provide a universal stringer clamp that replaces all of the different clamps that would be required if prior clamping techniques were employed. Other objects of the present invention were to eliminate the requisite machining of the clamping surfaces so that they would conform to the precise angles dictated by stringer orientation at each of the clamping locations, to provide a clamp that could alternatively be used at each of the stringer clamping locations and thus eliminate assembly errors that would otherwise result from the use of an incorrect clamp, to provide a clamp that is adjustable and self-aligning, and to provide a clamp that could be locked in its self-aligned position thereafter not requiring realignment when one wing panel was removed from the jig and new stringers positioned on the clamps. And lastly, it was an object of the present invention to achieve the foregoing objectives while producing a more economical and simpler stringer clamp.

SUMMARY OF THE INVENTION

In accordance with the foregoing objects, and other objects that will become apparent to one of ordinary skill in the art as he reads the following specification, the present invention provides a clamp for securing a member having generally intersecting surface portions to a jig. The clamp comprises a clamp base adapted for mounting on the jig member. A locator means is mounted on the base clamp for rotational movement about a rotational axis. The locator means has a first, substantially planar clamping surface oriented parallel to or coincident with the rotational axis and a second, convexly arcuate clamping surface. The second clamping surface is a locus of lines oriented generally transversely to the first clamping surface. Preferably, the locus of lines defining the second clamping surface is oriented substantially perpendicularly to the first clamping surface. A clamp means is also operatively associated with the base means for holding a member to be clamped, such as a wing stringer, against the first and second clamping surfaces of the locator means. The clamp means includes a J-shaped member having a first end and a second end. The J-shaped member has a shank terminating at the first end, joined to a curved portion terminating at the second end. The shank is mounted in the clamp base for rotational and sliding movement about the longitudinal axis of the shank. The J-shaped member is mounted and constructed so that the second end is selectively positionable adjacent the intersection of the first and second clamping surfaces.

BRIEF DESCRIPTION OF THE DRAWINGS

A better understanding of the present invention can be derived by reading the ensuing specification in conjunction with the accompanying drawings wherein:

FIG. 4 is a side elevation view of the stringer clamp of the present invention with a stringer clamped in place;

FIG. 5 is a front elevation view of the stringer clamp of the present invention without a stringer;

FIG. 6 is a plan view of the stringer clamp shown in FIGS. 4 and 5;

FIG. 7 is a view of the stringer clamp of the present invention showing the J-shaped clamping member rotated out of its clamping position so that a stringer can be removed from or placed on the clamping surfaces;

FIG. 8 is a view of the stringer clamp of the present invention taken along view line 8—8 of FIG. 7.

DETAILED DESCRIPTION OF THE INVENTION

Figure 1:
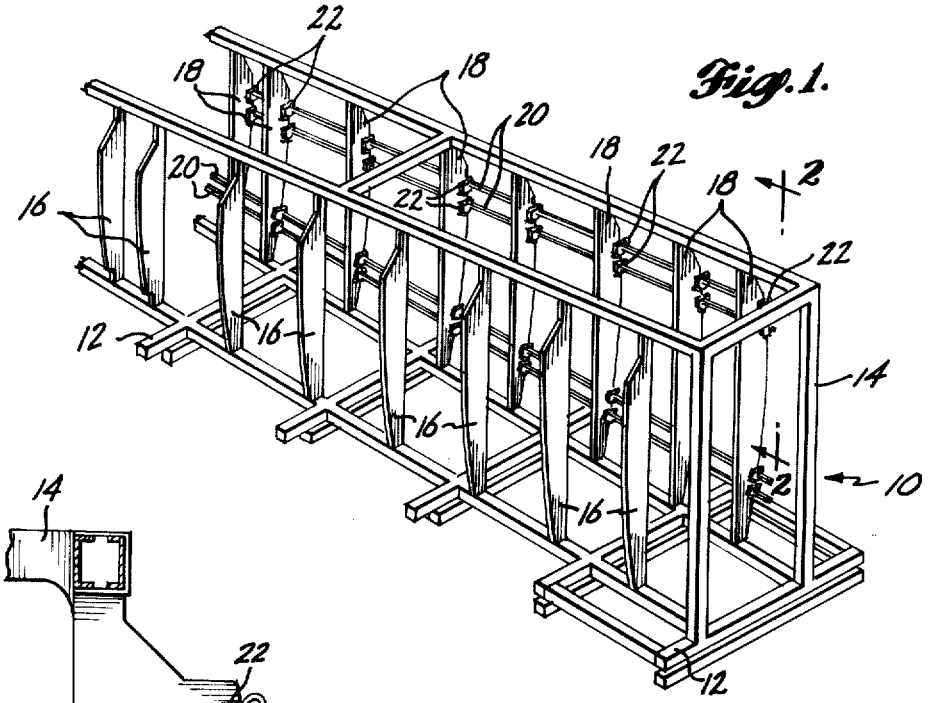
FIG. 1 is an isometric view of a wing jig carrying a plurality of headers upon which a plurality of the stringer clamps of the present invention is mounted.

Referring first to FIG. 1, the inboard segment of a wing panel jig 10 is illustrated. The jig comprises a base 12 and an upper frame 14. A first set of headers 16 for a lower wing panel is mounted on the frame 14 in parallel relationship. The exposed edges of the headers 16 are curved to conform to the configuration of the skin on a lower wing panel. Similarly, a second set of headers 18 for an upper wing panel is mounted on the frame 14 opposite the headers 16. The headers 18 are also arranged in parallel relationship and have outer curved edges that conform to the configuration of the upper surface of a wing. The illustrated jig assembly is for the upper and lower panels for a left wing. A jig that is a mirror image of the illustrated jig is employed to support and construct the upper and lower panels of a right wing. Stringers 20, spanwise reinforcing members for a wing skin, are arranged in generally parallel relationship on the headers. In FIG. 1, only four stringers 20 of the sixteen or more that are employed to construct a single wing panel are illustrated. The stringers 20 are fastened to the headers 18 via stringer clamps 22 constructed in accordance with the present invention. A wing skin is then attached to the stringers with conventional fasteners.

Figure 2:
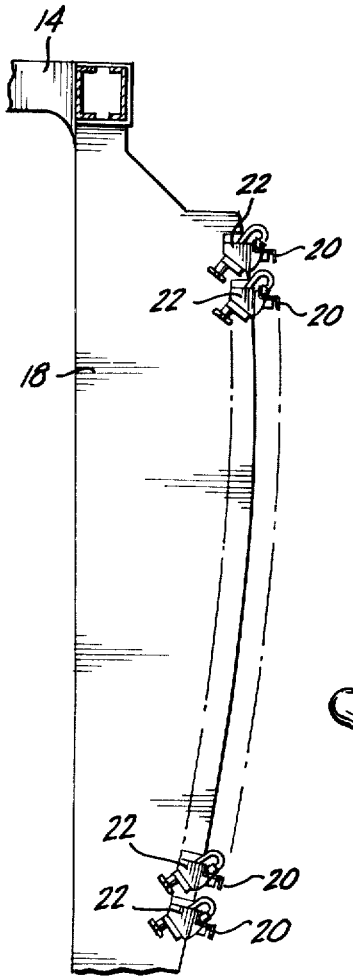
FIG. 2 is an enlarged view taken along a section line 2—2 of FIG. 1 showing a header and a plurality of stringer clamps mounted on the header.
Figure 3:
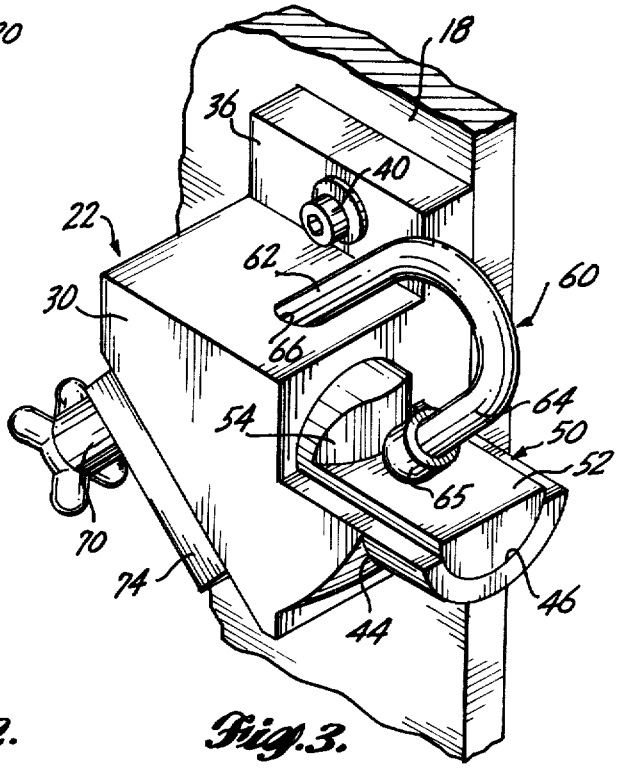
FIG. 3 is an isometric view of a stringer clamp and a segment of a header.

Referring to the enlarged view of FIG. 2, the central and upper portion of an upper wing panel header 18 is shown affixed to the jig frame 14. As shown, two forward stringers 20 are held in position by clamps 22 while two aft stringers 20 are held in position by an additional pair of clamps 22. The remaining intermediate stringers and stringer clamps positioned between the four shown are represented by the dot-dash outline for simplicity. Each of the clamps is attached to the header 18 at predetermined positions so that the stringers 20 are precisely located both chordwise and spanwise relative to each other so that accurately constructed and reproducible wing panels can be formed with successive sets of stringers and wing skins.

Referring now to more detailed views of FIGS. 3, 4, 5, and 6, base 30 of the stringer clamp 22 has a flat back surface 34, an upwardly extending integral mounting flange 36 and a downwardly extending integral mounting flange 38. Each of the flanges 36 and 38 carries a bore that is respectively aligned with predrilled bores in the header 18. The predrilled bores are located on the headers so that the clamp is precisely positioned relative to a desired stringer locaton. Fasteners 40 and 42 secure the mounting flanges 36 and 38 and thus the base 30 to the header 18.

The built up forward portion 44 of the base carries an upwardly opening trough 46 having a generally cylindrical surface. A cylindrical recess 48 extends rearwardly into the body of the base 30. A locator generally designated 50 has a cylindrical rearward portion having a diameter that is slightly less than the cylindrical recess 48 in the base 30. The cylindrical portion of the locator 50 fits into the cylindrical recess 48 for rotational movement about the rotational axis coincident with the cylindrical axis of the locator 50 and the axis of generation of both the trough 46 and cylindrical recess 48. The forward portion of the locator 50 is generally semicylindrical in configuration. The bottom cylindrical surface of the forward portion of the locator 50 engages and is supported by the trough 46 on the base 30. The upper forward portion of the locator 50 forms a first clamping surface 52. The first clamping surface 52 is planar and generally parallel to the rotational axis of the locator 50. Midway between the forward and rearward ends of the locator 50 is a second clamping surface 54 that is convexly arcuate in configuration. The second clamping surface 54 is defined generally by a locus of lines oriented transversely and preferably perpendicularly to the clamping surface 52.

A circumferential slot 56 is formed in the bottom portion of the trough 46. The semicylindrical forward portion of the locator 50 carries a threaded bore 57 that is aligned with the slot 56. A threaded fastener 58 is inserted through the slot 56 to threadably engage the bore 57 in the locator 50 so that when the fastener 58 is tightened down, it secures the locator 50 in any of a plurality of desired positions. Additionally, the fastener 58 when loose serves to retain the locator 50 in engagement with the trough and the cylindrical recess 48 while allowing the locator to rotate about its rotational axis.

A generally J-shaped securing clamp 60 has a shank 62 and an integral semicircularly curved portion 64. The shank 62 is longitudinally and rotationally mounted in a bore 66 in the base 30. The bore 66 is oriented in the base so that the threaded terminus 68 of the shank 62 extends beyond the bottom surface 32 of the clamp 30. The bottom surface 32 is oriented generally perpendicularly to the axis of the bore 66. The upper end of the bore 66 exits from the top surface of the clamp base 30 and is spaced rearwardly from the locator 50 such that the terminus of the curved end 64 terminates adjacent the central portion of the intersection of the clamping surfaces 52 and 54. The terminus of the curved portion 64 is capped with an end cap 65 composed of a resilient and durable polymeric material such as polytetrafluoroethylene or high molecular weight polyethylene.

Referring now to FIGS. 4, 7, and 8, a manipulable internally threaded knob 70 threadably engages the threaded terminus of the shank 62. The knob 70 has an upper surface 72 that is oriented generally parallel to the bottom of the clamp base 30. A generally rectangular latch member 74 having two parallel faces oriented parallel with the bottom surface 32 of the clamp base 30 is pivotally mounted by a pivot pin 76 for swinging movement adjacent the bottom surface 32 of the clamp base 30. The pivot axis of the latch member 74 is oriented generally parallel to but spaced from the shank 62. The latch member 74 carries a slot 78 that opens onto one of its sides at a distance from the pivot pin 76 equal to the distance between the pivot pin 76 and the shank 62. Thus, the latch member 74 can be swung from a closed position juxtaposed between the upwardly facing surface 72 of the knob 70 and the bottom surface 32 of the clamp base 30 and an open position laterally spaced from the knob 70 to free the shank for rapid longitudinal movement. The slot 78 accommodates the shank when the latch member 74 is in its closed position.

Still referring to FIGS. 4, 7, and 8, the clamp is operated in the following sequence. The latch member 74 is moved to its open position out of juxtaposition between the knob and the base 30 (as shown in FIG. 8) such that the shank 62 can be moved longitudinally upwardly without the necessity of turning the knob 70 several turns. At the same time, the curved portion 64 of the clamp 60 is rotated about the axis of the shank so that it is completely free of the clamping surfaces 52 and 54 (as shown in FIG. 7). As shown in FIG. 4, and in FIGS. 5 and 6 by the dot-dash lines, a stringer 20 can then be positioned on the clamping surfaces 52 and 54. Because the orientation of the stringer 20 in both the spanwise and chordwise directions is predetermined by the design of the wing panel, the rearwardly and downwardly facing surfaces of the stringer 20, which are generally L-shaped in configuration, will not present themselves in orthogonal alignment to the reference surfaces of the clamp and header. Instead, the angle in which the bottom surface is oriented, for example, may vary through the arc indicated between reference lines 80 in FIG. 5. Similarly, the orientation of the rearwardly facing surface may vary through the arc indicated by reference lines 82 in FIG. 6. Because the locator 50 can rotate about its rotational axis in the trough 46, the upwardly facing, planar clamping surface 52 can be oriented so that it is coplanar with the bottom or downwardly facing surface of the stringer 20. Likewise, because the forwardly facing, convexly arcuate clamping surface 54 is convexly arcuate, at least one vertical surface will present itself to the rearwardly facing surface of the stringer 20 regardless of its angular orientation, as for example can be seen by reference to FIG. 6.

Once the stringer is in position in engagement with the clamping surfaces, the curved portion 64 of the clamp 60 is rotated downwardly and the shank moved longitudinally downwardly and rearwardly so that the end cap 65 engages the upwardly and forwardly facing surfaces of the stringer adjacent the clamping surfaces. Thereafter, the latch member 74 is swung into its closed position in juxtaposition between the knob 70 and the bottom surface 32 of the clamp base 30. The knob is then tightened against the latch member to secure the clamp member 60 and thus the stringer 20 in position. The latch member 74 allows the shank 62 to be moved axially through a significant distance without requiring a large number of turns on the knob 70 to tighten or loosen the clamp member 60.

Once the locator 50 of a given clamp at a given location has been correctly positioned relative to the stringer orientation, placement of successive stringers on the locator will not require repositioning of the locator 50 relative to the clamp base 30. Thus, the threaded fastener 58 is provided so that it can be tightened and thus prevent movement of the locator 50 when removing and replacing stringers.

As can be seen, the adjustable clamp of the present invention is self-aligning so that it can be utilized at virtually any location on the wing jig, thus eliminating separately designed machine clamps for each of the clamping locations. As a consequence, only a small number of the universally adjustable and self-aligning clamps need be stored. When needed, a given replacement clamp can be bolted into position at any required location to substitute for a damaged clamp. Additionally, if only the locator or the clamping surfaces become damaged, only that portion of the clamp need be replaced.

Although the present invention has been disclosed in relation to a preferred embodiment, one of ordinary skill, after reading the foregoing specification, will be able to effect various alterations, substitutions of equivalents and other changes without departing from the broad concepts disclosed herein. Accordingly, it is intended that the grant of Letters Patent hereon be limited only by the definition contained in the appended claims and equivalents thereof.

The embodiments of the invention in which an exclusive property or privilege is claimed are defined as follows:

1. In an airplane wing panel jig including a plurality of headers, an improved clamp for clamping stringers to said headers comprising:

a clamp base and means for mounting said base to a header, locator means having a rotational axis, a first clamping surface oriented substantially parallel to said rotational axis thereof, and a second convexly arcuate clamping surface, said second clamping surface being a locus of lines generally perpendicular to said first clamping surface, mounting means for mounting said locator means on said clamp base for rotational movement about said rotational axis, and a J-shaped member having a shank terminating in a first end and having a curved portion terminating in a second end, said shank being mounted in said clamp base for rotational and sliding movement about the longitudinal axis of said shank, said J-shaped member being mounted and constructed so that said second end is selectively positionable adjacent the intersection of said first and second clamping surfaces.

2. A clamp for securing a member having intersecting surface portions to a jig member, comprising:

a clamp base adapted for mounting on said jig member, locator means having a rotational axis and having a first substantially planar clamping surface oriented parallel to said rotational axis and having a second convexly arcuate clamping surface, said second surface being a locus of lines oriented transversely to said first clamping surface, mounting means for mounting said locator means on said clamp base for rotational movement about said rotational axis, and clamp means operatively associated with said clamp base for clamping said member to said locator means, said clamp means including a J-shaped member having a first end and a second end, said J-shaped member having a shank terminating at said first end, joined to a curved portion terminating at said second end, said shank being mounted in said clamp base for rotational and sliding movement about the longitudinal axis of said shank, said J-shaped member being mounted and constructed so that said second end is selectively positionable adjacent the intersection of said first and said second clamping surfaces.

3. The clamp of claim 2 wherein said first end of said J-shaped member protrudes from said clamp base, said clamp further comprising:

a threaded member threadably engaging said first end of said J-shaped member, and a movable latch member and means for mounting said latch member for movement between a first position juxtaposed between said threaded member and said clamp base, and a second position spaced laterally from said first position, so that said shank can be axially moved until said threaded member abuts said base.

4. The clamp of claim 3, wherein said clamp means further comprises:

a locator pad having a spherical contact surface affixed to the second end of said J-shaped member.

* * * * *